US010201829B2

(12) United States Patent
Hung

(10) Patent No.: US 10,201,829 B2
(45) **Date of Patent: *Feb. 12, 2019**

(54) ASSEMBLY FOR A CARRIER FOR CARRYING A CAULK CARTRIDGE AND CAULKING GUN

(71) Applicant: SIANG SYUAN FU ENTERPRISE CO., LTD., Changhua County (TW)

(72) Inventor: Hung-Chih Hung, Changhua County (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/633,156

(22) Filed: Jun. 26, 2017

(65) Prior Publication Data

US 2017/0291190 A1 Oct. 12, 2017

Related U.S. Application Data

(63) Continuation-in-part of application No. 15/088,933, filed on Apr. 1, 2016, now Pat. No. 9,827,588.

(30) Foreign Application Priority Data

Apr. 2, 2015 (TW) ..... 104110790 A

(51) Int. Cl.

| | |
|---|---|
| ***B05C 17/01*** | (2006.01) |
| ***B05C 17/005*** | (2006.01) |
| *B05B 15/68* | (2018.01) |

(52) U.S. Cl.
CPC ..... *B05C 17/00596* (2013.01); *B05C 17/01* (2013.01); *B05C 17/0123* (2013.01); *B05B 15/68* (2018.02)

(58) Field of Classification Search
CPC ..... B05C 17/005; B05C 17/00506; B05C 17/00509; B05C 17/00513;
(Continued)

(56) References Cited

U.S. PATENT DOCUMENTS 2,626,731 A * 1/1953 Ekins ..... B05C 17/01 222/323
2,732,102 A * 1/1956 Ekins ..... B05C 17/0123 222/327

(Continued)

*Primary Examiner* — Patrick M. Buechner
(74) *Attorney, Agent, or Firm* — Muncy, Geissler, Olds & Lowe, P.C.

(57) ABSTRACT

A caulking gun includes a carrier for carrying a caulk cartridge, an assembly for the carrier, a gun body and a push rod. The assembly is for disposing between the gun body and the carrier and includes a seat portion and a spacing portion. The seat portion includes a seat wall for being connected between the gun body and the carrier. The spacing portion includes an annular projection portion configured to be abutted between the gun body and the carrier in a manner that the gun body and the carrier are rotatable relative to each other. The carrier is rotatably connected with the gun body through the assembly, and the carrier is rotatable relative to the annular projection portion. The push rod is movably connected to the gun body and disposed through the assembly, and extends into the carrier.

16 Claims, 10 Drawing Sheets

(58) Field of Classification Search
CPC ..... B05C 17/0052; B05C 17/00596; B05C 17/01; B05C 17/0123
See application file for complete search history.

(56) References Cited

U.S. PATENT DOCUMENTS 2,877,935 A * 3/1959 Sherbondy ..... B05C 17/01 222/326
2,889,085 A * 6/1959 Collins ..... B05C 17/0123 222/391
3,726,440 A * 4/1973 Deeb ..... B05C 17/0123 222/174
4,330,070 A * 5/1982 Doubleday ..... G01F 11/023 222/287
4,339,058 A * 7/1982 Wendt ..... G01F 11/026 222/309
4,469,153 A * 9/1984 Morrisette ..... B01F 11/0082 141/364
5,211,312 A * 5/1993 Chang ..... B05C 17/01 222/153.01
9,827,588 B2 * 11/2017 Hung ..... B05C 17/01

* cited by examiner

ASSEMBLY FOR A CARRIER FOR CARRYING A CAULK CARTRIDGE AND CAULKING GUN

FIELD OF THE INVENTION

This application is a Continuation-in-Part of application Ser. No. 15/088,933, filed on Apr. 1, 2016, for which priority is claimed under 35 U.S.C. § 120; and this application claims priority of Application No. 104110790 filed in Taiwan on Apr. 2, 2015 under 35 U.S.C. § 119, the entire contents of all of which are hereby incorporated by reference.

BACKGROUND OF THE INVENTION

Description of the Prior Art

Generally, caulk is usually used to fix gap, crack, crevice in buildings and decoration. The caulk is contained in a caulk cartridge, and a caulking gun can be used to push the caulk cartridge to extrude the caulk out from the conical outlet of the caulk cartridge. The conventional caulking gun, mainly, includes a gun body, a limitation portion and a carrier. The limitation portion is swingably attached to and cooperates with the gun body. An elastic portion is disposed in the gun body, and a push rod disposed through the gun body can be actuated to push the caulk cartridge to extrude the caulk out from the conical outlet of the caulk cartridge. However, the conventional caulking gun has following disadvantages. There are fixation parts disposed between the carrier and the gun body. However, to prettify the caulking gun, the gun body and the carrier each are usually coated with lacquer layer, colorful layer or the like, in which the lacquer layer, colorful layer or the like has a thickness, and lacquer layers, colorful layers or the like manufactured in different processes have different thicknesses. It is noted that if the lacquer layer, colorful layer or the like on the carrier has a sufficient thickness, there will exist a gap between the carrier and caulking gun, so that the carrier is unstable and easy to rock. If the lacquer layer, colorful layer or the like on the carrier has an overthick thickness, the carrier will be tightly connected to the gun body. As a result, the carrier is therefore non-rotatable relative to the gun body, the orientation of the outlet of the caulk cartridge cannot be adjusted, and thus it is inconvenient to apply the caulking gun for various requirements (such as two edges of a wall perpendicular to each other, or the like).

The present invention is, therefore, arisen to obviate or at least mitigate the above mentioned disadvantages.

SUMMARY OF THE INVENTION

An object of the present invention is to provide an assembly for a carrier for carrying a caulk cartridge and a caulking gun, in which the carrier and a gun body can be stably connected with each other without rocking, and the carrier is allowed to be orientationally rotated and frictionally positioned.

To achieve the above and other objects, an assembly for a carrier of a caulking gun, for disposing between a gun body of the caulking gun and a carrier for carrying a caulk cartridge, including: a seat portion, including a seat wall, for being connected between the gun body and the carrier; a spacing portion, including an annular projection portion, the annular projection portion configured to be abutted between the gun body and the carrier in such a manner that the gun body and the carrier are rotatable relative to each other.

To achieve the above and other objects, a caulking gun is provided, including the assembly for the carrier of the caulking gun, further including: a gun body; a carrier, rotatably connected with the gun body through the assembly for the carrier of the caulking gun, the carrier being rotatable relative to the annular projection portion; a push rod, movably connected to the gun body, disposed through the assembly for the carrier of the caulking gun, extending into the carrier.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
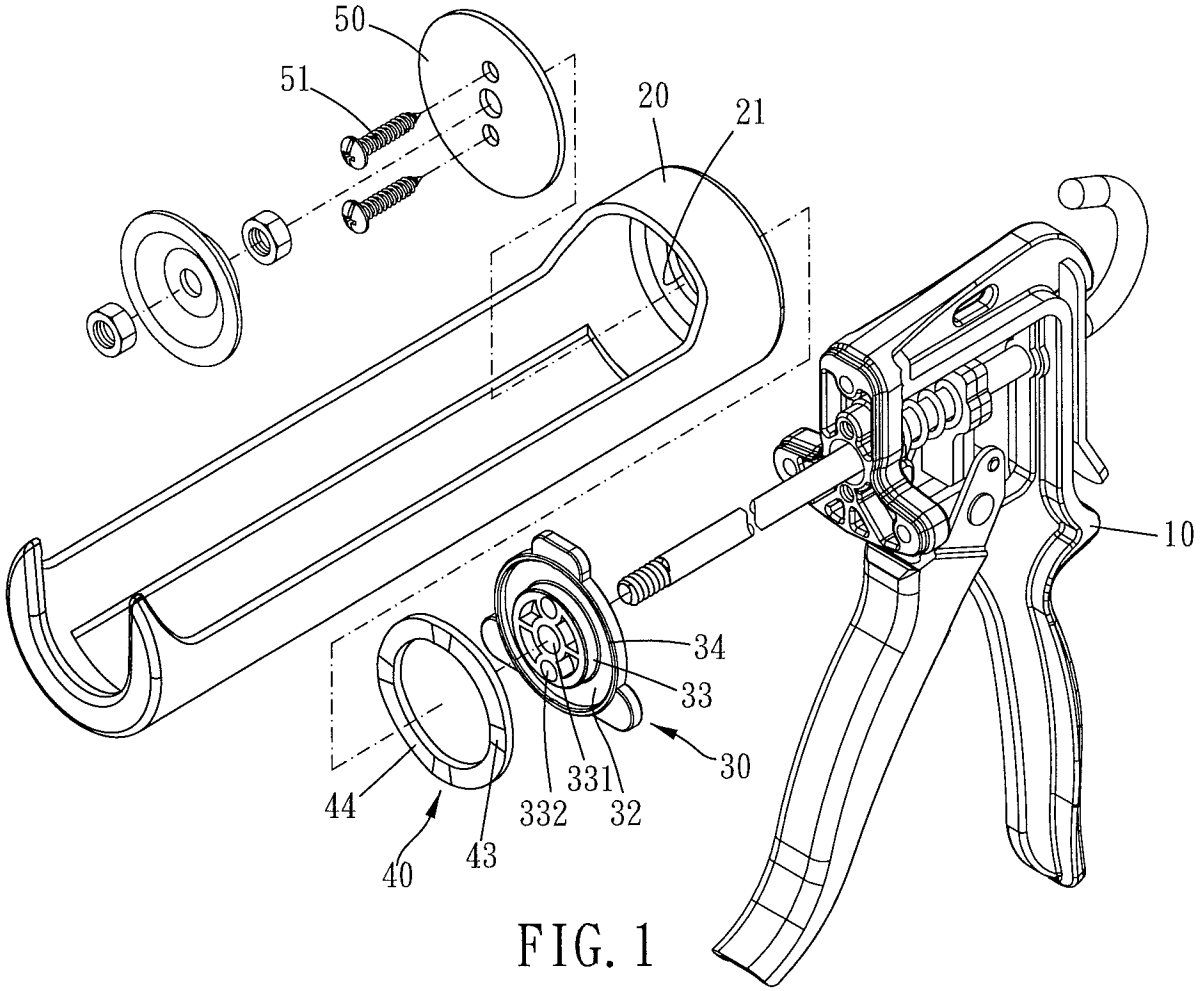
FIG. 1 is an explosion drawing of a first preferred embodiment of the present invention.
Figures 2, 3:
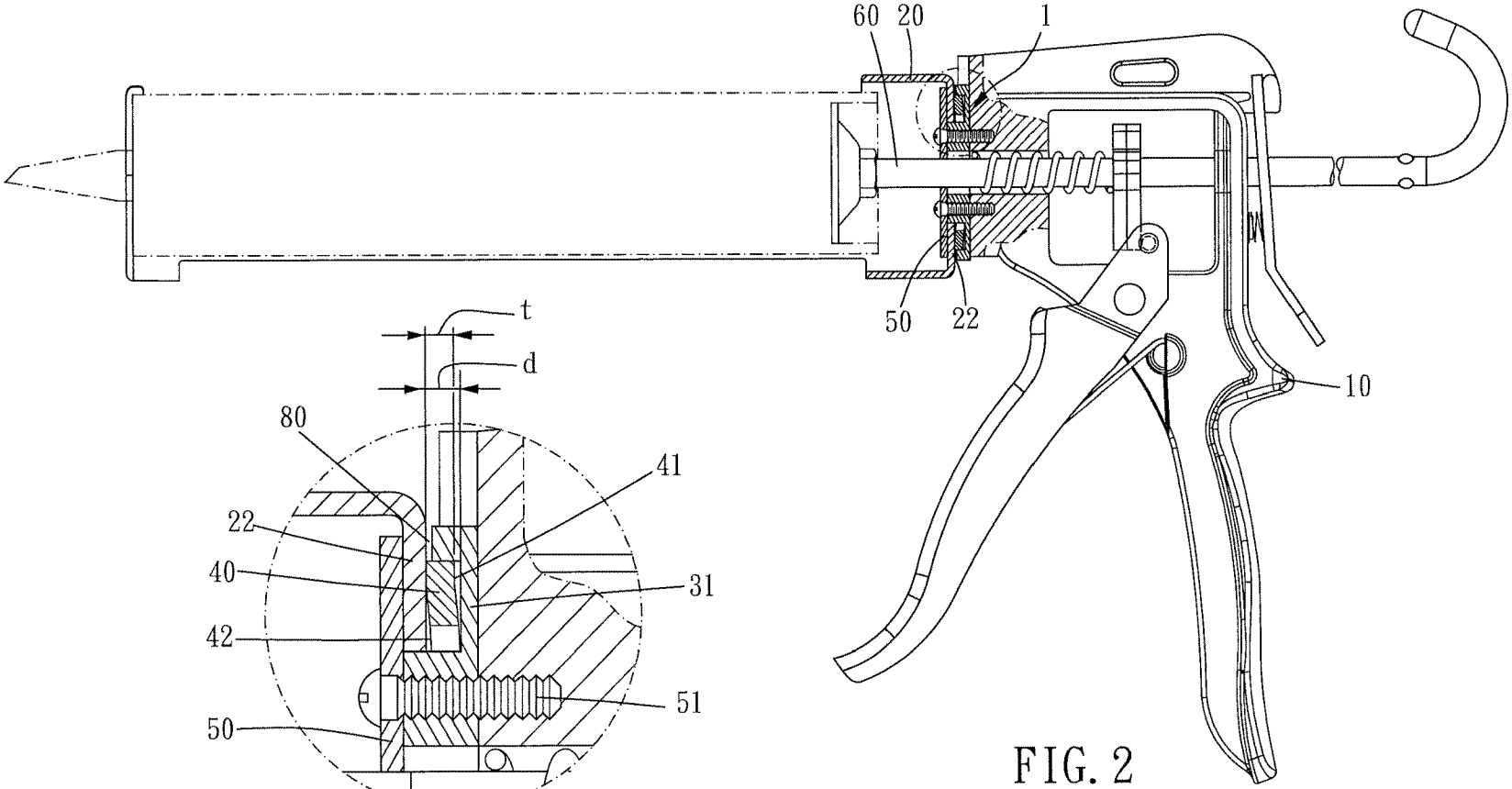
FIG. 2 is a partial cross-sectional view of the first preferred embodiment of the present invention.
FIG. 3 is an enlarged drawing of FIG. 2.
Figure 4:
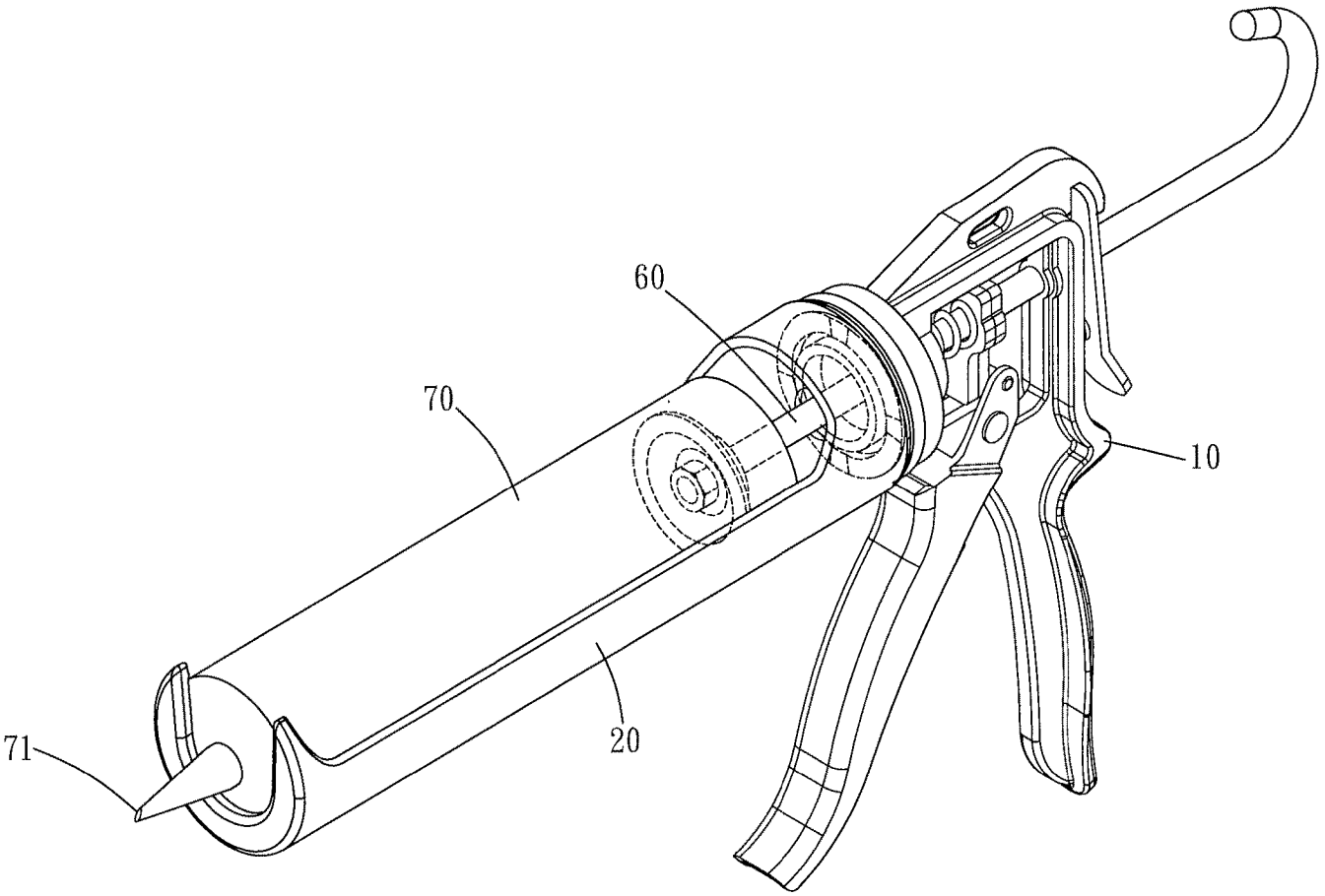
FIGS. 4 and 5 are drawings showing the first preferred embodiment of the present invention in use.
Figure 5:
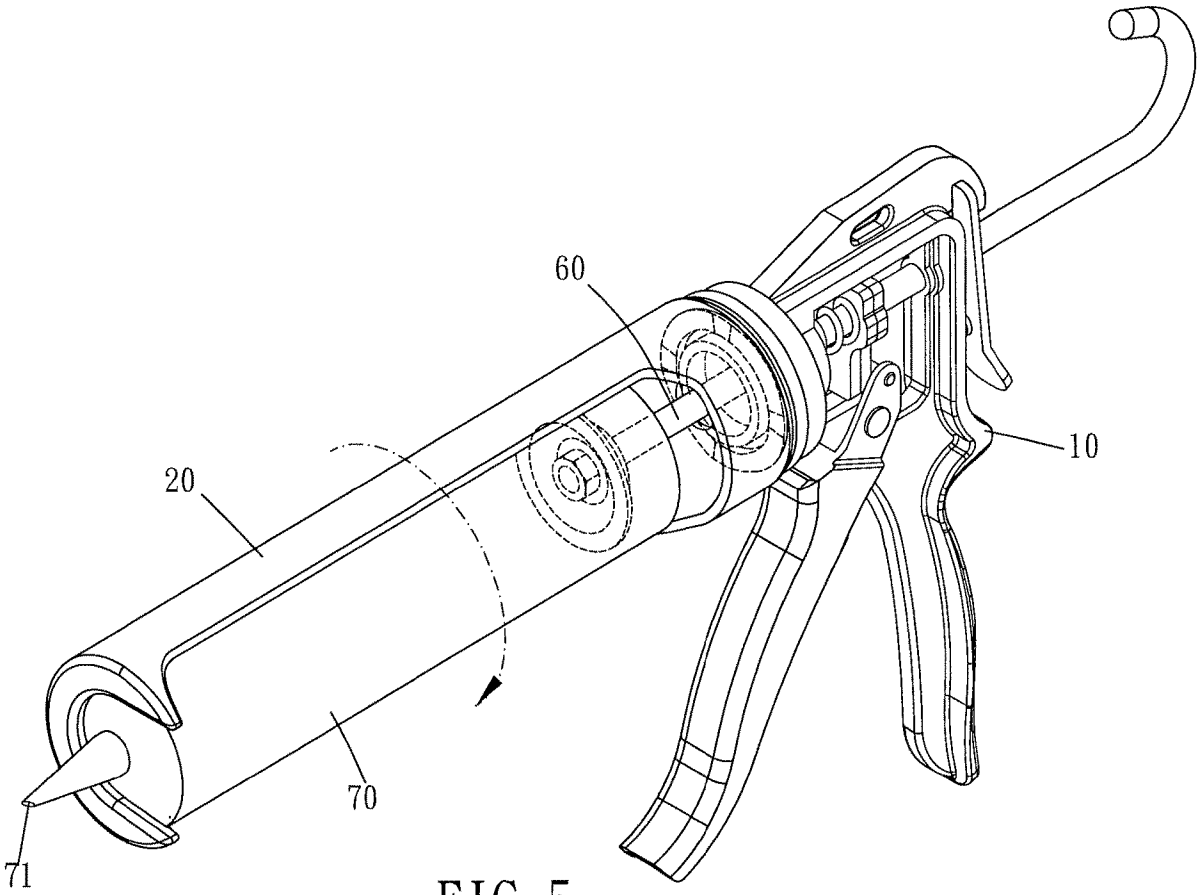

FIGS. 1-5 show an assembly 1 for a carrier of a caulking gun according to a first preferred embodiment of the present invention. The assembly 1 for the carrier of the caulking gun is for disposing between a gun body 10 of the caulking gun and a carrier 20 for carrying a caulk cartridge. The assembly 1 for the carrier of the caulking gun includes a seat portion 30 and a spacing portion 40. The seat portion 30 includes a seat wall 31 and is for being connected between the gun body 10 and carrier 20. The spacing portion 40 includes at least one projection portion. The at least one projection portion is disposed on the seat wall for being abutted between the gun body 10 and the carrier 20 in such a manner that the gun body 10 and the carrier 20 are rotatable relative to each. Preferably, the spacing portion 40 includes at least three of the projection portions, and the at least three projection portions are circumferentially spaced on the seat wall 31 and for the carrier 20 rotatable abutment of the carrier thereagainst. Whereby, the magnitude of frictional contact between the carrier 20 and the gun body 10 is controllable and adjustable, the carrier 20 can be stably held without rocking, and the carrier 20 is allowed to be orientationally rotated and frictionally positioned by utilizing the assembly 1 for the carrier of the caulking gun.

The seat portion 30 may be integrally formed as a part of the gun body 10. The spacing portion 40 may be integral with the seat portion 30 and may be made of/from metal, plastic, silicon, rubber or a combination thereof. The at least three projection portions are preferably elastically deformable (including elastically deformable in material or in assembled-structure). In this embodiment, the seat portion 30 is a plate body and includes a recess 32, and the seat portion 30 may be made of/from metal, plastic, silicon, rubber or a combination thereof. The spacing portion 40 is an elastic metal sheet and includes a first side 41 and a second side 42 opposite to each other. The first side 41 is received in the recess 32 and abutted against the seat wall 31. The second side 42 includes four projection portions 43 and a plurality of depression portions 44 alternatively arranged with the four projection portions 43. The four projection portions 43 protrude beyond the seat portion 30. Specifically, the recess 32 is an annular groove, and the spacing portion 40 is a waved-ring plate. The waved-ring plate includes the four projection portions 43 and the depression portions 44, and the depression portions 44 are spaced on the seat wall 31. The four projection portions 43 are for abutting against the carrier 20 in non-fully-surface contact. Preferably, the waved-ring plate has a thickness t equal to less than a depth d of the annular groove, thus providing sufficient tolerance for deformation of the spacing portion 40. It is noted that each of the at least three projection portions may be an individual member attached to the seat portion. The at least one projection portion may be abutted against the gun body. The at least one projection portion may be a single extending projection which is, for example, arched, annular, elongated, polygonal or the like. The spacing portion may be polygonal or in any shape.

A middle of the seat portion 30 facing the second side 42 includes a tubular body 33. The tubular body 33 includes a central hole 331 and a plurality of voids 332 around the central hole 331, thus reducing weight and providing slightly deformability. The tubular body 33 is for corresponding to a through hole 21 of the carrier 20, and the waved-ring plate is disposed around the tubular body 33. The seat portion 30 further includes an outer flange 34 around the tubular body 33. Corresponding to the second side 42, the tubular body 33 protrudes beyond the outer flange 34, and the four projection portions 43 protrudes beyond the tubular body 33, so as to ensure that the spacing portion 40 and the carrier 20 contact with each other in multiple points and they are stably assembled without rocking.

In this embodiment, the assembly 1 for the carrier 20 of the caulking gun further includes a clamp member 50 and two fasteners 51 (it is possible to use at least one fastener; a single fastener and the clamp member may be integrally formed of one piece), and the fastener 51 is screw. The clamp member 50 and the spacing portion 40 are for being disposed by two side of an axially-facing wall 22 of the carrier 20, and the two fasteners 51 are disposed through the clamp member 50 and for being fixed to the gun body 10. Specifically, the two screws 51 are disposed through the clamp member 50, the axially-facing wall 22 of the carrier 20 and a tubular wall of the tubular body 33 (such as parts of the voids 332) and fixed to the gun body 10.

Figure 6:
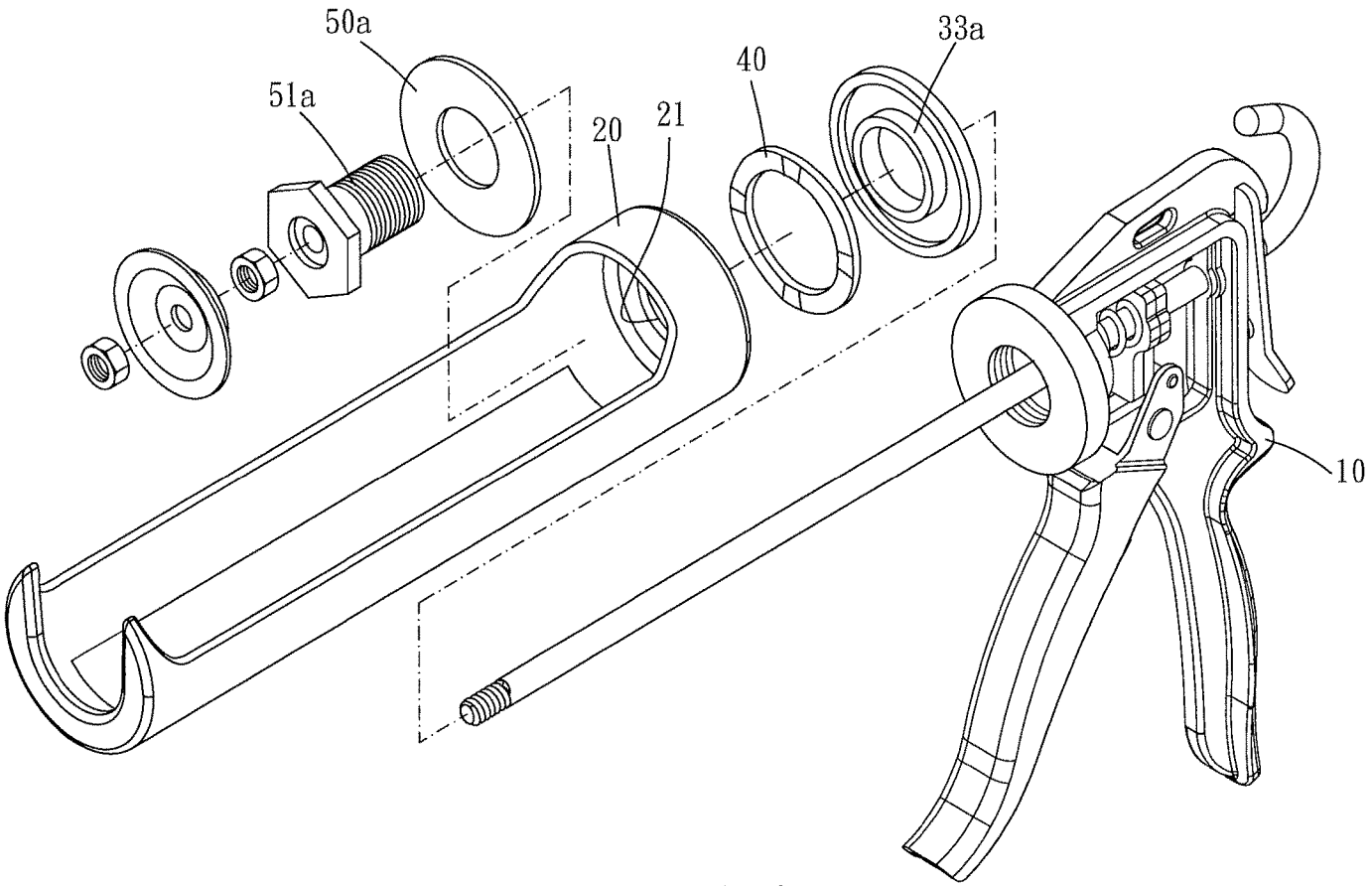
FIG. 6 is an explosion drawing of a second preferred embodiment of the present invention.
Figures 7, 8:
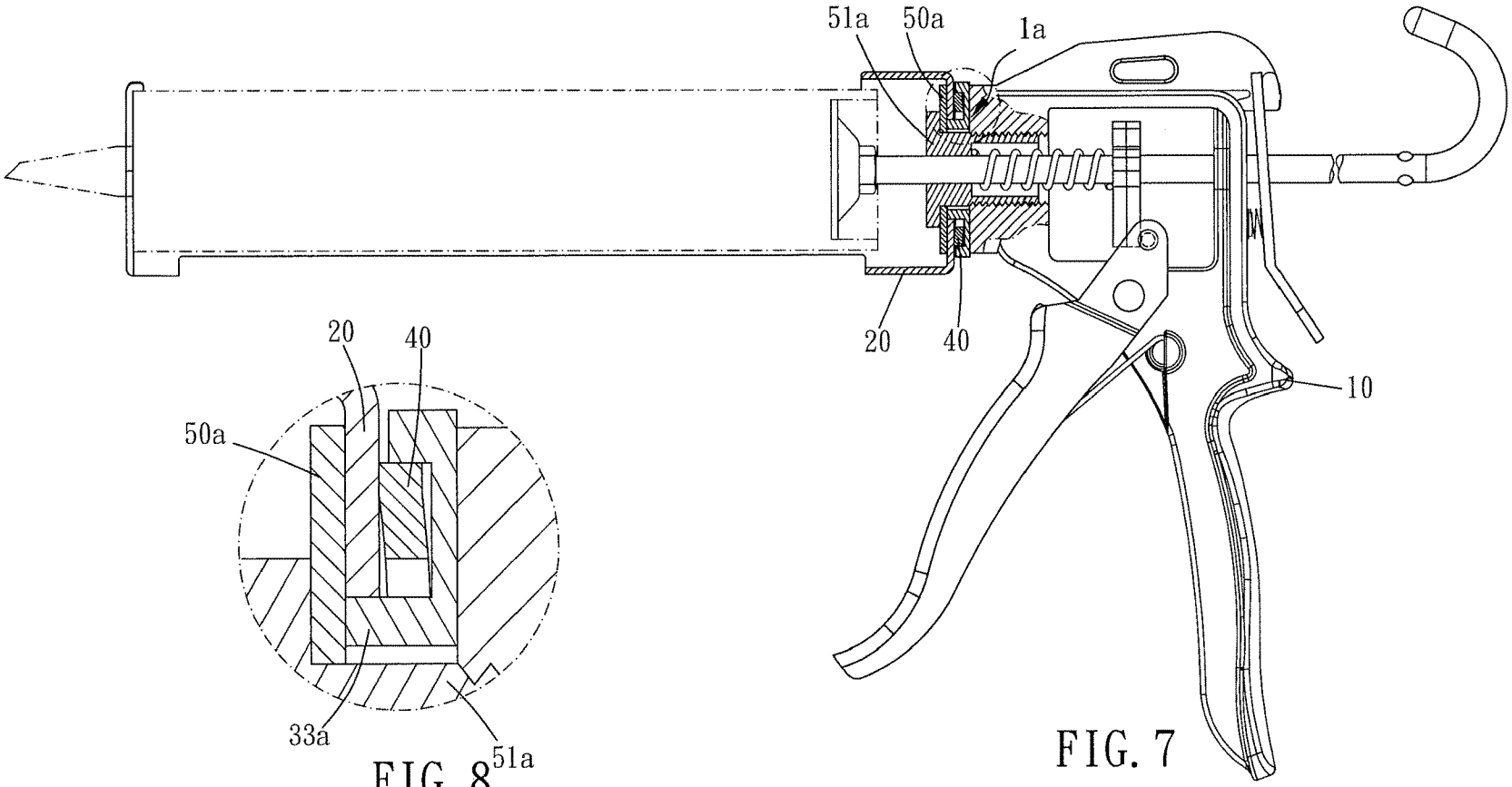
FIG. 7 is a partial cross-sectional view of the second preferred embodiment of the present invention.
FIG. 8 is an enlarged drawing of FIG. 7.
Figures 9, 10, 11:
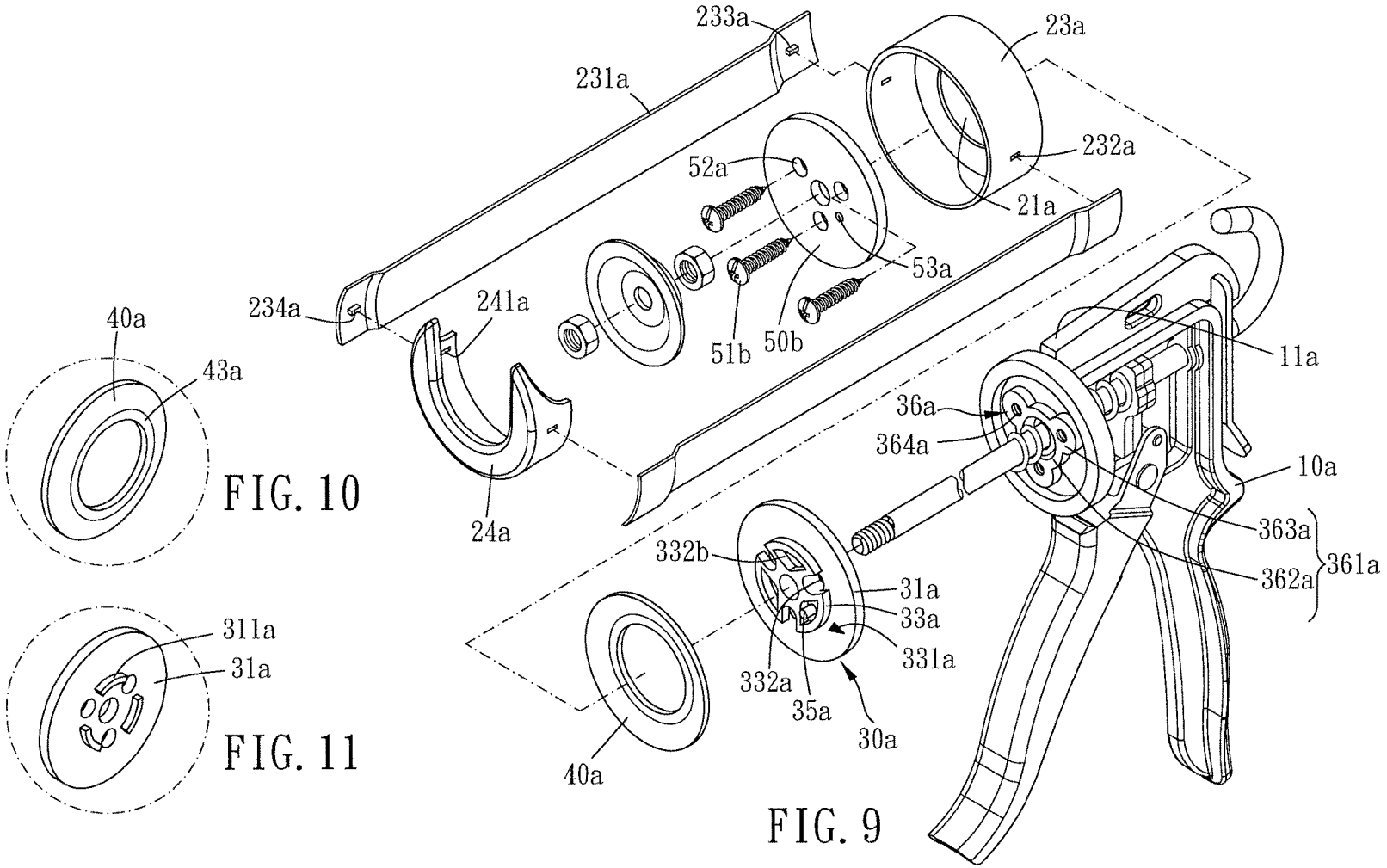
FIG. 9 is an explosion drawing of a third preferred embodiment of the present invention.
FIG. 10 is a drawing showing a spacing portion of the third preferred embodiment of the present invention.
FIG. 11 is a drawing showing a seat portion of the third preferred embodiment of the present invention.
Figure 12:
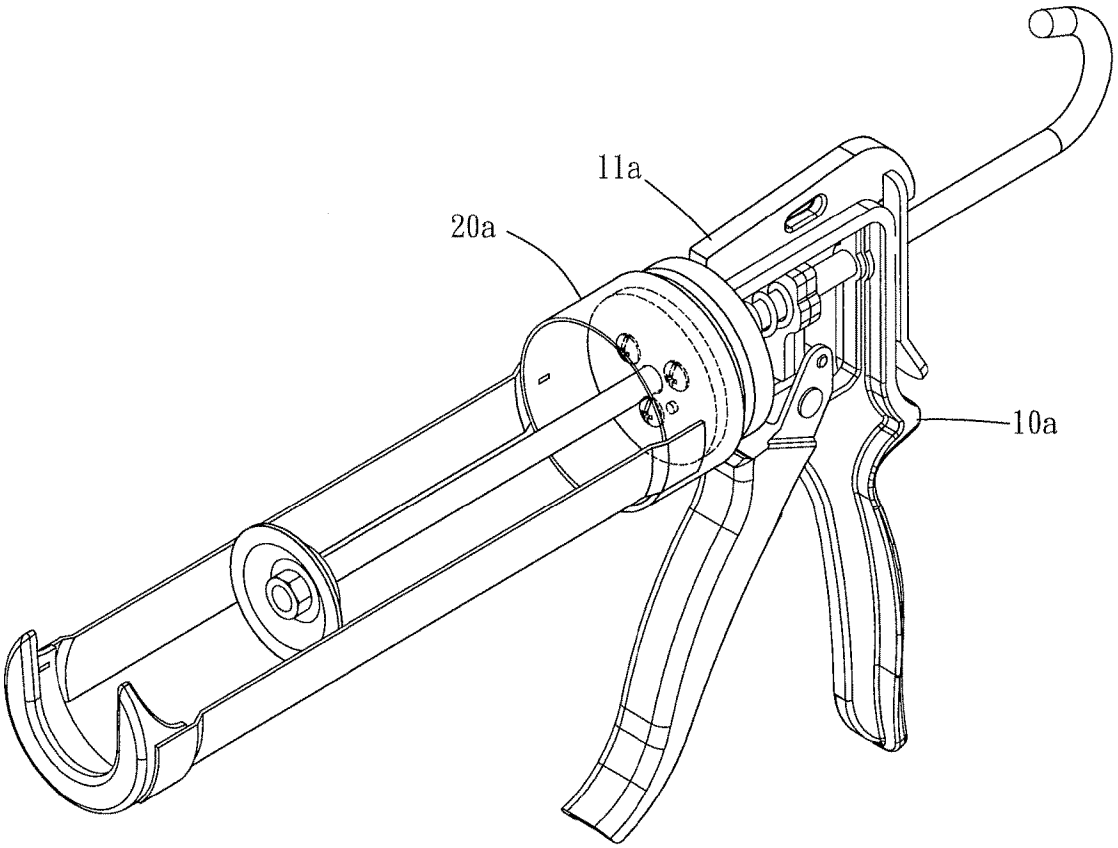
FIG. 12 is a perspective view of the third preferred embodiment of the present invention.
Figure 13:
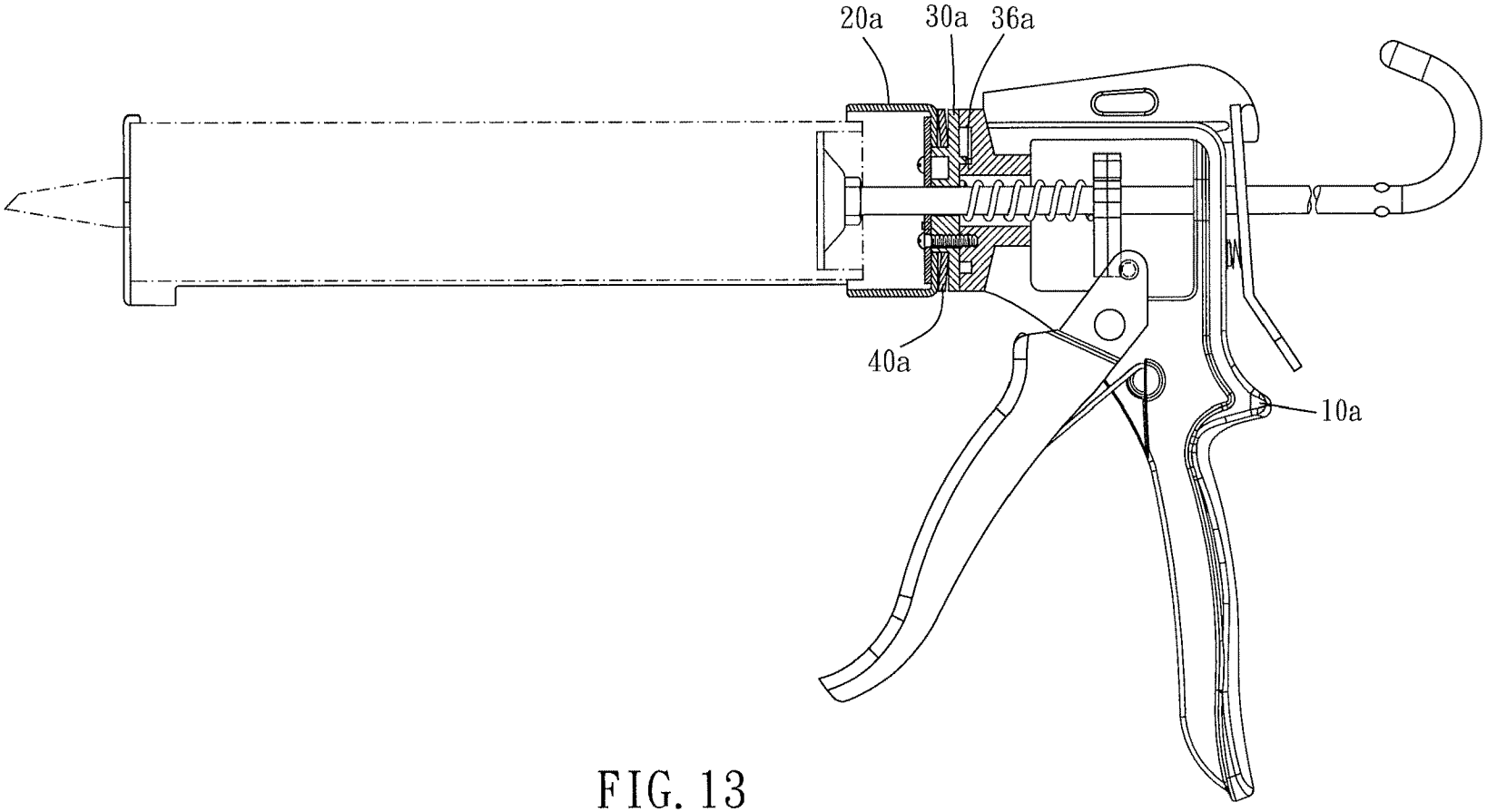
FIG. 13 is a side view of the third preferred embodiment of the present invention.
Figure 14:
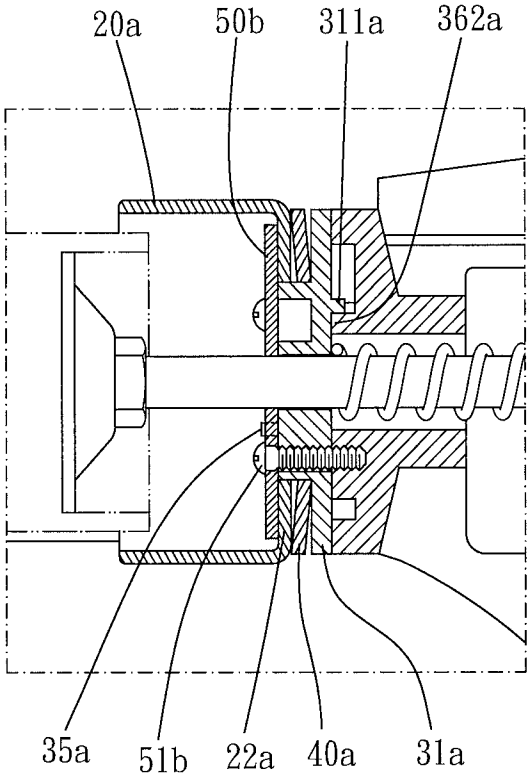
FIG. 14 is an enlarged drawing of FIG. 13.

As shown in FIGS. 6-8, in a second embodiment, an assembly 1*a* for a carrier of a caulking gun includes a hollow bolt 51*a*, the hollow bolt 51*a* is coaxially disposed through the clamp member 50*a*, the through hole 21 of the carrier 20, the spacing portion 40 and the tubular body 33*a* and fixed to the gun body 10. It is noted that the fastener and the clamp member may be integrally formed of one piece.

As shown in FIGS. 1-5, a caulking gun is further provided. The caulking gun includes an assembly 1 for a carrier of a caulking gun mentioned in the first embodiment (or may be assembly 1*a* in the second embodiment), a gun body 10, a carrier 20 and a push rod 60. The carrier 20 is rotatably connected with the gun body 10 through the assembly 1 for the carrier of the caulking gun and, and the carrier 20 is slidable relative to the projection portion 43. The push rod 60 is movably connected to the gun body 10, and the push rod 60 is disposed through the assembly 1 for the carrier of the caulking gun and extends into the carrier 20 for pushing a caulk cartridge 70 supported by the carrier 20 to discharge caulk. Preferably, the projection portions 43 abut against the axially-facing wall 22 of the carrier 20, the tubular body 33 abuts against the clamp member 50, and the outer flange 34 and the axially-facing wall 22 of the carrier 20 form a gap 80 therebetween, so that the carrier 20 can be stably held without rocking due to suitable friction provided by the projection portions 43, and the carrier 20 will not be frictionally restrained to be not rotatable. As a result, according to various requirements (such as two edges of a wall perpendicular to each other, or the like), the orientation of an outlet 71 of the caulk cartridge 70 is positionably orientated in a specific angle (see FIGS. 4 and 5). It is noted that, at least one washer may be further disposed between the spacing portion 40 and the axially-facing wall 22 of the carrier 20, or the tubular body 33 may be not disposed through the through hole of the carrier 2, and the tubular body 33 abuts against the axially-facing wall 22.

In a third embodiment as shown in FIGS. 9-14, the spacing portion 40*a* includes an annular projection portion 43*a*, and the annular projection portion 43*a* is configured to be abutted between the gun body 10*a* and the carrier 20*a* in such a manner that the gun body 10*a* and the carrier 20*a* are rotatable relative to each other.

The seat portion 30*a* further includes an axial projection portion 33*a* which is disposed on the seat wall 31*a* and configured to be disposed within the a through hole 21*a* of the carrier 20*a*, the annular projection portion 43*a* is disposed around the axial projection portion 33*a*, and the annular projection portion 43*a* is configured to be abutted between the seat wall 31*a* and the carrier 20*a*. The spacing portion 40*a* is a ring plate disposed around the axial projection portion 33*a*.

The seat portion 30*a* further includes a plurality of voids. The plurality of voids include a plurality of through holes 332*a* penetrating through the axial projection portion 33*a* and the seat wall 31*a* and being radially open on the axial projection portion 33*a*. The plurality of voids further include a plurality of blind holes 332*b*, and the plurality of blind holes 332*b* and the plurality of through holes 332*a* are annularly alternatively arranged on the axial projection portion 33*a*.

The assembly for the carrier 20*a* of the caulking gun further includes a clamp member 50*b* and at least one fastener 51*b*, the clamp member 50*b* and the spacing portion 40*a* are configured to be disposed by two side of an axially-facing wall 22*a* of the carrier 20*a*, and each fastener 51*b* is disposed through the clamp member 50*b* and one of the through holes 332*a* and is configured to be fixed to the gun body 10*a*. The clamp member 50*b* includes a plurality of penetrating holes 52*a*, each fastener 51*b* is disposed through one of the plurality of through holes 332*a* and one of the plurality of penetrating holes 52*a*. The clamp member

50*b* further includes a positioning hole 53*a*, and the axial projection portion 33*a* further includes a boss 35*a* disposed within the positioning hole 53*a*.

The assembly for the carrier 20*a* of the caulking gun further includes a seat base 36*a* configured to be integrated with the gun body 10*a*, the seat wall 31*a* includes a plurality of arced ribs 311*a*, the seat base 36*a* includes an axial protrusion 361*a* having a plurality of circumferential arced flanges 362*a* connected between a plurality of blocking portions 363*a*, and the plurality of arced ribs 311*a* radially correspond to the plurality of circumferential arced flanges 362*a* and are circumferentially located between the plurality of blocking portions 363*a*, respectively, thus preventing free rotation of the seat wall 31*a* relative to the seat base 36*a*.

The plurality of blocking portions 363*a* each have a fixation hole 364*a* in which the fastener 51*b* is fixedly engaged. The axial projection portion 33*a* further includes an index 331*a* configured to be referred to a reference portion 11*a* (may be a mark) of the gun body 10*a* for alignment of the plurality of through holes 332*a*, the plurality of penetrating holes 52*a* and the fixation holes 364*a* of the plurality of blocking portions 363*a*.

The carrier 20*a* of the caulking gun includes a tubular member 23*a* which has the axially-facing wall 22*a* and near the seat portion 30*a* and two side plates 231*a* which extend axially from the tubular member 23*a*, the annular projection portion 43*a* is abutted between the seat wall 31*a* and the axially-facing wall 22*a*, the tubular member 23*a* further includes two engaging grooves 232*a*, and the two side plates 231*a* each further include a projection 233*a* which is engaged into one of the two engaging grooves 232*a*. The carrier 20*a* of the caulking gun further includes a bracket 24*a* away from the seat portion 30*a*, and the two side plates 231*a* which extend axially from the bracket 24*a* toward the seat portion 30*a*, the bracket 24*a* further includes two engaging grooves 241*a*, and the two side plates 231*a* each further include a projection 234*a* which is engaged into one of the two engaging grooves 241*a*.

In this embodiment, the annular projection portion 43*a* is abutted between the seat wall 31*a* and the axially-facing wall 22*a*, the axially-facing wall 22*a* is coated with paint, the spacing portion 40*a* is an elastic plastic member, and the seat portion 30*a* is a rigid plastic member relative to the elastic plastic member. As a result, friction between the axially-facing wall 22*a* and the spacing portion 40*a* is greater than that between the spacing portion 40*a* and the seat portion 30*a*, so that the spacing portion 40*a* can rotatably slide on the seat wall 31*a* and damage to the paint coated on the axially-facing wall 22*a* is avoided.

It is noted that the projection portion may contact the seat portion or the carrier, the projection portion may be additionally attached to or integrally formed as a part of the seat portion, or the projection portion may be additionally attached to or integrally formed as a part of the carrier.

Given the above, through the projection portion of the assembly for a carrier of a caulking gun, the carrier and the gun body can be stably connected with each other without rocking, and the carrier is allowed to be orientationally rotated and frictionally positioned.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An assembly for a carrier of a caulking gun, for disposing between a gun body of the caulking gun and the carrier for carrying a caulk cartridge, including:

a seat portion, including a seat wall, for being connected between the gun body and the carrier;

a spacing portion, including an annular projection portion, the annular projection portion configured to be abutted between the gun body and the carrier in such a manner that the gun body and the carrier are rotatable relative to each other.

2. The assembly for the carrier of the caulking gun of claim 1, further including a seat base configured to be integrated with the gun body, wherein the seat wall includes a plurality of arced ribs, the seat base includes an axial protrusion having a plurality of circumferential arced flanges connected between a plurality of blocking portions, and the plurality of arced ribs radially correspond to the plurality of circumferential arced flanges and are circumferentially located between the plurality of blocking portions, respectively.

3. A caulking gun, including the assembly for the carrier of the caulking gun of claim 1 and a push rod, wherein the carrier is rotatably connected with the gun body through the assembly for the carrier of the caulking gun, the carrier is rotatable relative to the annular projection portion, and the push rod is movably connected to the gun body, disposed through the assembly for the carrier of the caulking gun and extends into the carrier.

4. The caulking gun of claim 3, wherein the carrier includes a tubular member which has an axially-facing wall and two side plates which extend axially from the tubular member, the annular projection portion is abutted between the seat wall and the axially-facing wall, the tubular member further includes two engaging grooves, and the two side plates each further include a projection which is engaged into one of the two engaging grooves.

5. The caulking gun of claim 3, wherein the carrier includes a bracket and two side plates which extend axially from the bracket toward the seat portion, the bracket further includes two engaging grooves, and the two side plates each further include a projection which is engaged into one of the two engaging grooves.

6. The caulking gun of claim 3, wherein the carrier includes a tubular member which has an axially-facing wall, the annular projection portion is abutted between the seat wall and the axially-facing wall, the axially-facing wall is coated with paint, the spacing portion is an elastic plastic member, and the seat portion is a rigid plastic member relative to the elastic plastic member.

7. The assembly for the carrier of the caulking gun of claim 1, wherein the seat portion further includes an axial projection portion which is disposed on the seat wall and configured to be disposed within a through hole of the carrier, the annular projection portion is disposed around the axial projection portion, and the annular projection portion is configured to be abutted between the seat wall and the carrier.

8. The assembly for the carrier of the caulking gun of claim 7, wherein the spacing portion is a ring plate disposed around the axial projection portion.

9. The assembly for the carrier of the caulking gun of claim 7, wherein the seat portion further includes a plurality of voids.

10. The assembly for the carrier of the caulking gun of claim 9, wherein the plurality of voids include a plurality of through holes penetrating through the axial projection portion and the seat wall and being radially open on the axial projection portion.

11. The assembly for the carrier of the caulking gun of claim 10, wherein the plurality of voids further include a plurality of blind holes, and the plurality of blind holes and the plurality of through holes are annularly alternatively arranged on the axial projection portion.

12. The assembly for the carrier of the caulking gun of claim 10, further including a clamp member and at least one fastener, wherein each fastener is disposed through the clamp member and one of the through holes and is configured to be fixed to the gun body.

13. The assembly for the carrier of the caulking gun of claim 12, wherein the clamp member includes a plurality of penetrating holes, each fastener is disposed through one of the plurality of through holes and one of the plurality of penetrating holes.

14. The assembly for the carrier of the caulking gun of claim 12, wherein the clamp member further includes a positioning hole, and the axial projection portion further includes a boss disposed within the positioning hole.

15. The assembly for the carrier of the caulking gun of claim 13, further including a seat base configured to be integrated with the gun body, wherein the seat wall includes a plurality of arced ribs, the seat base includes an axial protrusion having a plurality of circumferential arced flange connected between a plurality of blocking portions, the plurality of arced ribs radially correspond to the plurality of circumferential arced flanges and are circumferentially located between the plurality of blocking portions, respectively, the plurality of blocking portions each have a fixation hole, and each fastener is fixedly engaged in one of the fixation.

16. The assembly for the carrier of the caulking gun of claim 15, wherein the axial projection portion further includes an index configured to be referred to a reference portion of the gun body for alignment of the plurality of through holes, the plurality of penetrating holes and the fixation holes of the plurality of blocking portions.

* * * * *